US006648219B1

(12) United States Patent
Daunell

(10) Patent No.: US 6,648,219 B1
(45) Date of Patent: Nov. 18, 2003

(54) HAND HELD PIPE BENDING CALCULATOR

(76) Inventor: David Daunell, P.O. Box 685, Woodacre, CA (US) 94973

( * ) Notice: Subject to any disclaimer, the term of this patent is extended or adjusted under 35 U.S.C. 154(b) by 151 days.

(21) Appl. No.: 10/050,652

(22) Filed: Jan. 14, 2002

Related U.S. Application Data

(60) Provisional application No. 60/262,876, filed on Jan. 12, 2001.

(51) Int. Cl.[7] ..... G06C 27/00

(52) U.S. Cl. ..... 235/78 R; 235/88 R; 235/74

(58) Field of Search ..... 235/74, 78 R, 235/78 A, 78 M, 88 R, 88 M

(56) References Cited

U.S. PATENT DOCUMENTS 3,803,389 A * 4/1974 Yelverton ..... 235/78 N
3,971,915 A * 7/1976 Fletcher et al. ..... 235/61 NV
3,986,002 A * 10/1976 DeMaio ..... 235/78 R
5,691,523 A * 11/1997 Calvo ..... 235/78 R

* cited by examiner

*Primary Examiner*—Karl D. Frech
(74) *Attorney, Agent, or Firm*—Larry D. Johnson; Craig M. Stainbrook; Johnson & Stainbrook, LLP

(57) ABSTRACT

A mechanical annular hand held pipe bend calculator that enables a worker to calculate the angle of bend necessary for pipe given the distance between bends and the depth of offset or saddle; or to calculate the depth of offset or saddle, if given the angle of bend and the distance between bends; or to calculate the distance between bends, given the angle of bend and the dept of offset or saddle. The calculator also enables the worker to quickly calculate the amount of shrink or take up caused by having to bend pipe between two points.

9 Claims, 1 Drawing Sheet

HAND HELD PIPE BENDING CALCULATOR

CROSS REFERENCE TO RELATED APPLICATIONS

The present application claims the benefit of the filing date of U.S. Provisional Application Ser. No. 60/262,876, filed Jan. 12, 2001.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to hand held calculators, and more particularly to a hand held pipe bending calculator that enables a workman to calculate offsets, saddles, and shrink.

BACKGROUND INFORMATION AND DISCUSSION OF RELATED ART

Conventional linear slide rules and their annular cousins are well known. The devices generally comprise a mechanical devices having at least two numerical scales in movable relationship with one another so as to make a specific kind or kinds of calculations. Some early examples of calculators having an annular or disc shape include U.S. Pat. No. 697,861 to MacCollin, which teaches a mechanical calculator; U.S. Pat. No. 784,660 to Chritton, which teaches a lumber computer; U.S. Pat. No. 3,181,787 to Burns, which teaches a wall construction computer; U.S. Pat. No. 3,436,014 to Ochonicky, which teaches a heater calculator; and U.S. Pat. No. 3,716,015 to Godfrey, which teaches a measuring device to represent a value in metric and British length scales. These devices are specific to the function they perform and are not adapted for use in calculating pipe bends and lengths.

U.S. Pat. No. 3,199,777 to Martens teaches a disc computer used to calculate the data necessary for the proper bending of pipe, particularly the pipe used in cross country pipe lines. The device comprises three concentrically mounted discs in rotatable relation to one another, the middle disc being the largest and bearing scales on each of its faces. The outer discs carry scales on their outer faces which, when related to the scales on the middle disc, may be employed to calculate the total angle and twist angle of pipe when the horizontal angle and vertical angle are known. However, this device does not provide means to calculate shrink or take up of pipe resulting from bends made in the pipe.

U.S. Pat. No. 4,689,476 to Katz discloses a mariner's dogleg course distance calculator. The calculator is a disc-shaped slide rule having a fixed base and an opaque slide element in sliding arrangement with respect to the fixed base. The base is provided with a scale of numbered indicia representative of rhumb line or direct course distances to the destination station. Underlying the slide element the base element is also provided with a table of numbered distance indicia comprising discrete running distances to be negotiated to the destination station at a number of dogleg or zig-zag course departure angles. The slide element of the calculator includes an array of windows, each of which represent a specific departure angle and which may be juxtaposed over the individual running distance indicia of the distance table of the fixed base so as to expose appropriate dogleg course distance information when the slide element is indexed to a specific rhumb line course distance displayed on the fixed base element. Each window of the slide element is also provided with reference indicia keying the specific departure angle represented thereby.

U.S. Pat. No. 4,308,451 to Shedlock teaches an overlap distance indicating device intended to allow a worker to determine the amount of overlap required to maintain lines of an angled section parallel and spaced throughout by a constant distance, from linear measurements of the slope or run of an angled section and the linear measurement of the rise of that angled section. The device comprises two fixed discs and two rotatable disc interposed between the two fixed discs. The rotatable disc has numerical indicia on one of the two surfaces that correspond to linear measurements of the run and slope of an angled section, and disposed on the other surface are indicia corresponding to linear measurements of overlapped distances. One of the two fixed discs has a window for exposing selected portions of the indicia corresponding to the slope and run of an angled section in correlation with adjacent indicia corresponding to the rise of an angled section. The other one of the two fixed discs has a window for exposing selected portions of the indicia corresponding to the overlap distances, in correlation with adjacent indicia which corresponds to the spacing distances between the lines of each section.

Finally, U.S. Pat. No. 5,691,523 to Calvo describes a machinery shaft alignment calculator for determining shimming requirements for a drive unit to be coupled with a driven unit in angular alignment. The circular slide rule device utilizes drive unit support separation data, coupling structure diameter, and measured angular offset values to determine shimming requirements for angular alignment of the drive and driven units, by shim addition or removal to the supports of the drive unit.

Of the known devices, none describes or teaches a hand held apparatus capable of calculating the angles for offset and saddle bends, and for calculating shrink or take up.

BRIEF SUMMARY OF THE INVENTION

The present invention provides calculations directed and dedicated to workmen who install generally linear materials that must be bent for installation around other structures or for functional reasons, e.g., electrical conduit or plumbing pipe. The calculator comprises a lower circular disc and a concentric upper disc of smaller diameter in rotatable relationship to the lower disc. The upper disc includes a window through which may be viewed a numerical scale printed or impressed on the lower disc representing a continuous range of degrees of pipe or conduit bend that are commonly used in electrical conduit work (or any other applicable industry). The user simply dials in the degree of bend to be used and a first numerical scale at the perimeter of the upper disc aligns with a second numerical scale at the perimeter of the lower disc to show the relationship between the depth of pipe/conduit offset desired and the distance between bends.

The visual display provided by the present invention is similar to the display provided by well-known photographic light meters, but rather than showing a range of exposure combinations for f-stops and shutter-speeds based on user-selected luminance units of light, the pipe bending calculator of the present invention indicates the range of depth-of-offset/distance-between-bends combinations for a given bend in degrees.

DETAILED DESCRIPTION OF THE INVENTION

Figure 1:
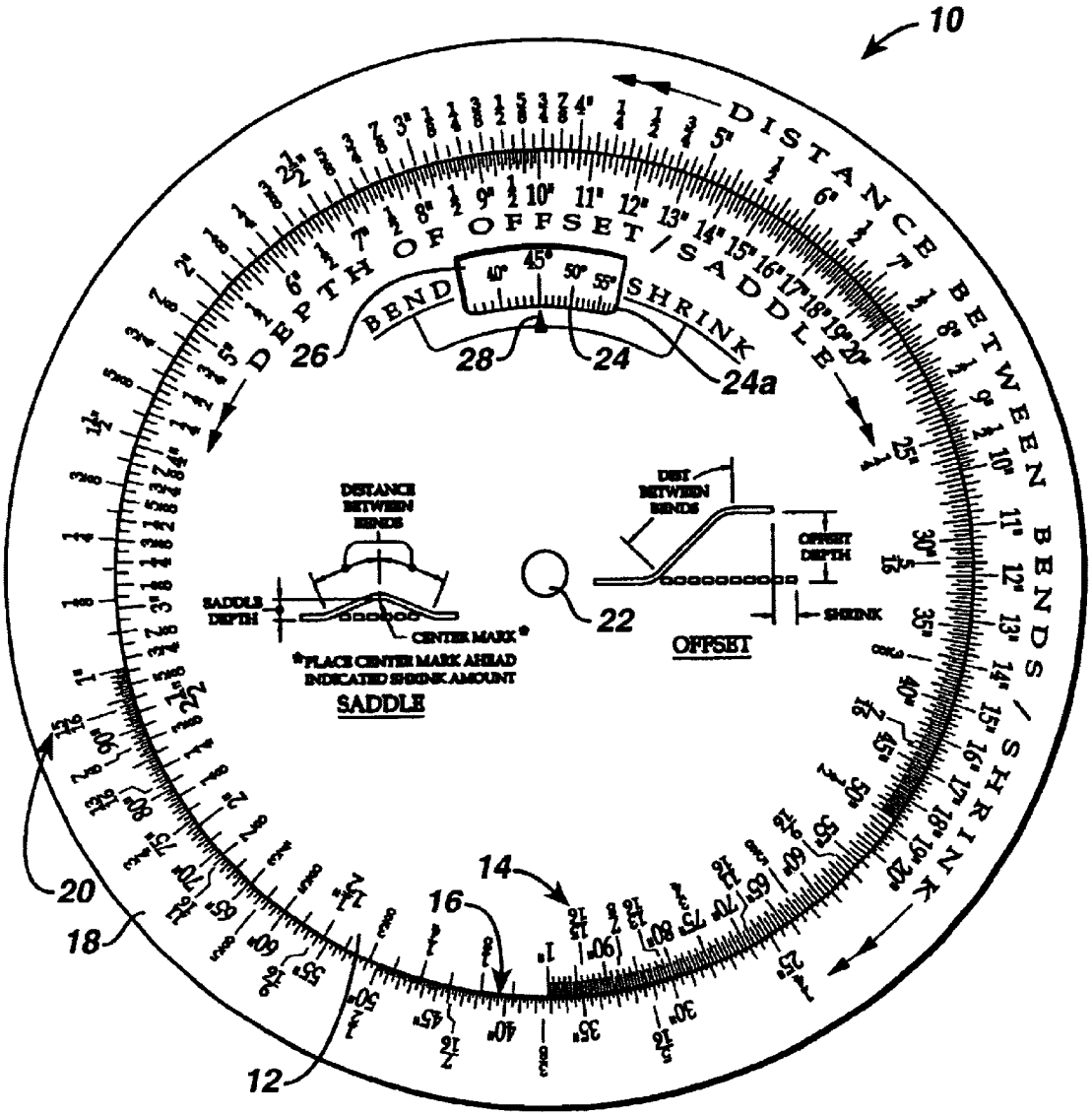
FIG. 1 is an exact enlarged reproduction of the top view of the pipe bend calculator of the present invention.

FIG. 1 is a top view of the pipe bend calculator of the present invention. This view shows that the pipe bend calculator of the present invention 10 comprises an upper, generally annular disc 12, having a first arcuate numerical scale 14 graduated in inches and fractions of inches and impressed and/or imprinted at the circumferential perimeter 16 of the upper disc. Rotatably coupled to the upper disc is a lower disc 18 having a larger diameter than the upper disc and having a second arcuate numerical scale 20 also graduated in inches or fractions of inches. The second scale is in proximity to the circumferential perimeter of the upper disc 16, such that the first and second scales may be aligned. The first scale relates to the depth of either an offset or saddle desired for a pipe bend or conduit; the second scale relates to the corresponding distance between bends for a given angle of bend. The discs are coupled by a concentric rivet 22.

As will be readily appreciated by those with skill in the art, the units of measurement of the scales may be either metric or British units and may vary in size according to the dimensions of the materials to be employed in the bending tasks.

Critical to the effective mathematical task performed by this device is the 1×/2×distance-around-scales/units-of-measurement relationship of the scales. The precise location of the numerical marks for each of the outer (circumferential) scales is calculated by the equation:

$$\text{position}=\log x(y/\log z);$$

where x=the numerical position in units of measurement (e.g., inches); y=the physical measurement of the total scale in a selected measurement system—in this instance, 360 degrees because of the circular layout; and z=the total scale units. In the present case, the total of scale units is 99, as the scale begins with the number 1 and continues to and includes 100.

In its essential form, this layout shows the relationships of two sets of numbers for any given variable angle indicated on a third scale 24. In the present invention, a third arcuate numerical scale 24, imprinted on the lower disc, may be viewed through a window 26 and shows a continuous range of angles in degrees. The third scale, referred to as the "bend/shrink" scale, comprises two parts: a first part (not shown), known as the bend part, is a numerical scale with numbers representing degrees of angle, the numbers of which increase as one moves counterclockwise on the scale; the second part 24*a*, known as the "shrink" part, is an empirical numerical scale, spaced apart from the first and having numbers that increase as one moves clockwise on the scale. The marks indicating angles for the bend part of the third scale are found by multiplying the angle degree position sought by the cosecant of the angle and aligning the degree mark, i.e., pointing arrow 28, with the result. Conversely, the cosecant for any given angle of bend may be found by dividing the distance between bends by the depth of offset or saddle. The corresponding angle may then be located and marked on the lower disc where the pointing arrow indicates the solution to the equation. Using the rate of graduations defined by the solutions for angles between 10 degrees and 60 degrees, the bend part of the third scale inscribes an arc of approximately 90° around the lower disc.

Mark locations for the second part of the third scale, shown in FIG. 1, is derived empirically, i.e., by actually conducting the bending and measuring the shrink or take up. The shrink ratio is approximately 3/16 inch per inch of offset or saddle depth.

The second part of the third scale relates the amount of shrink or take up to the distance between bends and the depth of offset or saddle. The first part of the third scale, not shown in FIG. 1, relates the angle of bend to the distance between bends and the depth of offset or saddle. A pointing arrow 28 aligns the window with the third scale. Preferably, the first and second parts of the third scale include degrees of bend ranging from 10 to 60 degrees.

It is basic trigonometry that multiplying the cosecant of a given angle by the length of the opposite side of a right triangle gives the length of the hypotenuse of that right triangle. Thus, for a given range of angles there is a corresponding range of cosecants for the given angles in degrees.

The practical application of the hand held pipe bending calculator of the present invention involves finding the length of the hypotenuse. A workman—typically an electrician or other pipe or conduit fabricator—when bending conduit into an "offset" or "saddle" needs to know the distance between bends for a given angle of bend. The distance between bends is the same as the hypotenuse of the triangle defined by the bend. The length of the opposite side is the same as the depth of offset or saddle. Thus, when the electrician knows the depth of offset or saddle he desires and the bends he will use, the distance between the bends can easily be found. Likewise, when he knows the distance between bends and the depth of offset or saddle, he can find the angle of bend he requires.

Currently an electrician either does a "seat-of-the-pants" bend, in which event he visualizes the bend; or he finds the distance between bends by using multipliers printed either on a bending device or as found in the bending tables provided by some manufacturers of benders.

These approaches have several shortcomings, which may be summarized as follows: Eyeballing a bend usually requires making adjustments to the bend to obtain the desired depth of offset or saddle, unless the workman is remarkably lucky from the outset. An obvious disadvantage here is the inherent inefficiency; that is, it takes a considerable amount of time to complete a bend. Another disadvantage rests in the lack of consistency when completing a rack of bends, each following in succession, one from another. Even if one knows how to use the multipliers (and many do not) a calculator is probably required, and the result comes in a decimal form rather than the units of measurement commonly used in the United States. This requires conversions from decimal (metric) to base 12, and most electricians are not prepared to contend with this arithmetic nicety when their minds are occupied with the many other facets of electrical construction.

All the foregoing disadvantages of the commonly used methods are obviated by the use of the mechanical hand held pipe bending calculator of the present invention. The simplicity of using this invention prevents sloppy pipe bend "calculations" and the false economy of time resulting from eyeballing. Furthermore, with the use of this invention one can dispense with commonly used bending tables that provide solved examples of only a few bends and the multipliers for use in making myriad other bends. With the calculator of the present invention one can find the desired distance between bends along a continuous range of depths and the desired distance between bends along a continuous range of depth of offsets/saddles in the units of measurement actually used (unlike the decimal results of using a calculator).

The present invention superimposes a set of information over the multiplier (the range of degrees instead of the range of cosecants).

The calculator of the present invention also calculates "shrinkage" or "take-up" (i.e., the distance a bent pipe will fall short of its connection point as a result of the bend). As noted above, it easily solves for shrinkage by providing a an additional on the top disc in the mathematically correct position relative to the depth-of-offset/saddle scale. One solves for shrinkage by moving pointing arrow 28 to the degree of bends 24 to be used. Shrinkage is then found aligned with the depth of offset or saddle scale. For instance, in FIG. 1, pointing arrow 28 is aligned with 45° in the window 26. If the depth of offset or saddle is 10 inches (immediately above the point arrow for convenience), then the amount of shrink is found to be slightly more than 3⅝ inches and slightly less than 3¾ inches. It will be readily appreciated by those skilled in the art that calculations of shrinkage are of necessity somewhat approximate, owing to the varying sizes of conduit employed in construction. As a practical matter the differences in shrinkage may be overcome at the coupling or joint. However, it will also be readily appreciated that a plurality of bend/shrink scales, along with their corresponding windows, could be included in the calculator for performing more precise calculations specific to conduit sizes typically employed in a particular trade.

Steps for carrying out bends based on calculations made possible with the instant invention are as follows:

To calculate and make offset bends:

1. Obtain two measurements: (1) the distance from the last coupling or connector to the obstruction; and the height of the obstruction.

2. Add for shrink, if necessary (see shrink instructions, below). Add the amount of shrink to the distance from the last coupling or connector. Then mark the pipe with the distance from the last coupling or connector (with shrink added, as appropriate).

3. Find the distance between bends by dialing in the degree of bend to be used in window 26 on the second part of scale 24 (i.e., degrees of angle of bend). The distance between bends is then found on second scale 20 aligned with the height of the obstruction found on first scale 14. A second mark is placed this distance from the first mark.

4. (a) Bend the pipe using a bender having a stub arrow and teardrop or rim notch; the first mark should be aligned with the stub arrow. The second mark should be in or behind the shoe of the bender. (b) Make the first bend paying close attention to the accuracy of the bend as it is a predicate to making an accurate second bend. (c) Without removing the pipe from the bender, slide the second mark to the stub arrow and spin the pipe 180 degrees from the first bend. (d) Make the second bend.

To calculate and make saddles:

1. Obtain measurements as with offsets, including: (a) the distance from the last coupling to the center of the obstruction; and (b) the height of the obstruction.

2. Always add shrink with saddles (see shrink instructions, below). Add shrink amount to the distance from last coupling or connector to the center of the obstruction. Mark the pipe this distance from the end. This is the center mark.

3. Find the distance between bends. (Most saddles are made with 22.5 degree outside bends and a 45 degree center bend.) (a) Dial in the angle of bend to be used in the second part of the third scale 24. (Dial in the angle of the outside bends, not the center bend.) (b) Find the distance between bends in the second scale 20 aligned with the height of the obstruction in the first scale 14. (c) Mark the distance between bends from the center mark to each of the outside marks.

4. Mark the bends. (a) Make the center bend first, by placing the pipe into the bender with the center mark aligned with the teardrop or rim notch (depending on the particular bender). Bend the pipe 45 degrees. (b) Make the outer bends by aligning the outer marks with the stub arrow. When making the outer bends, the center bend should be out in front of the hook, not behind the shoe of the bender.

To calculate shrink or take up:

1. Dial in the degree of bend in the second part 24*a* of the third scale (the shrink graduations). For saddles, this represents the degrees of the outside bends.

2. Find the amount of shrinkage on the second scale 20 aligned with the height of the obstruction in the first scale 14. For offset bends comprising only two bends and wherein the pipe will diverge in a first bend from its original path but will not be brought into alignment with the pipe preceding the first bend, the numbers read on the second arcuate numerical scale constitute the solution to the problem of shrinkage. For saddle bends comprising three bends and wherein with the third bend the pipe will be brought back into alignment with the pipe preceding the first bend, it must be borne in mind that the shrink amount shown on the second arcuate numerical scale reflects the shrink amount at the center mark and must be multiplied by two (×2) for the total shrink.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A hand held mechanical pipe bending calculator, comprising:

an upper annular disc having a first arcuate numerical scale marked at its circumferential perimeter and having a window and a pointing arrow proximate said window, said first arcuate numerical scale graduated in units of linear measurement that relate to the depth of offset or saddle for a given bend of pipe;

a lower annular disc rotatably coupled to said upper disc, said lower disc having a larger diameter than said upper disc and having a second arcuate numerical scale graduated in units of linear measurement which relate to the distance between bends for a given angle of bend and which correspond to the depth of offset or saddle shown on said first arcuate numerical scale, said second arcuate numerical scale marked to be in proximity to said circumferential perimeter of said upper disc such that said first and second arcuate numerical scales may be aligned for calculations; and a third arcuate scale imprinted on said lower disc viewable through said window of said upper disc, said third scale graduated in degrees of angle and having a first part wherein the degrees of angle increase in a counterclockwise direction, and a second part wherein the degrees of angle increase in a clockwise direction, wherein each of said first and said second parts of said third arcuate scale relate to the degree of bend of an offset bend and to the degrees of the outside bends in a saddle.

2. The pipe bending calculator of claim 1, wherein said upper and lower disc are coupled by a concentric rivet.

3. The pipe bending calculator of claim 1, wherein said first part of said third arcuate scale is graduated in proportion to the cosecant of the angle marked on the graduation and relates the cosecant of the angle marked to the depth of offset or saddle to the distance between bends.

4. The pipe bending calculator of claim 1, wherein said second part of said third arcuate scale relates the amount of shrink or take up to the distance between bends of the pipe and the depth of offset or saddle.

5. The pipe bending calculator of claim 1, wherein said first part of said third arcuate scale relates the amount relates the angle of bend to the distance between bends and the depth of offset or saddle in a given bend of pipe.

6. The pipe bending calculator of claim 1, wherein said first and second parts of said third arcuate scale represent degrees of angle ranging from 10 degrees to 60 degrees.

7. The pipe bending calculator of claim 1, wherein said first and second arcuate numerical scales are graduated according to the equation:

$$\text{position}=\log x(y/\log z);$$

wherein x=the numerical position in units of measurement (e.g., inches); y=the physical measurement of the total scale in a selected measurement system; and z=the total scale units. In the present case, the total of scale units is 99, as the scale begins with the number 1 and continues to and includes 100.

8. The hand held pipe bending calculator of claim 7, wherein the marks for said first part of said third arcuate scale are graduated by dividing a given number on said second arcuate numerical scale by a given number on said first arcuate numerical scale, and are then located on said on said lower disc so as to be indicated by said pointing arrow proximate said window on said upper disc.

9. The hand held pipe bending calculator of claim 8, where said first and said second arcuate numerical scales are graduated in inches.

* * * * *